US008350656B2

(12) United States Patent
Cullen et al.

(10) Patent No.: US 8,350,656 B2
(45) Date of Patent: Jan. 8, 2013

(54) ROTARY TRANSFORMER

(75) Inventors: John J A Cullen, Derby (GB); Ellis F H Chong, Derby (GB); Felix L Langley, Leamington Spa (GB)

(73) Assignee: Rolls-Royce PLC, London (GB)

( * ) Notice: Subject to any disclaimer, the term of this patent is extended or adjusted under 35 U.S.C. 154(b) by 0 days.

(21) Appl. No.: 13/143,632

(22) PCT Filed: Jan. 8, 2010

(86) PCT No.: PCT/EP2010/000053
§ 371 (c)(1),
(2), (4) Date: Aug. 8, 2011

(87) PCT Pub. No.: WO2010/081654
PCT Pub. Date: Jul. 22, 2010

(65) Prior Publication Data

US 2011/0285491 A1 Nov. 24, 2011

(30) Foreign Application Priority Data

Jan. 14, 2009 (GB) ..... 0900493.8

(51) Int. Cl.
*H01F 21/06* (2006.01)

(52) U.S. Cl. ..... 336/130; 336/131; 336/132

(58) Field of Classification Search ..... 336/117, 336/119, 120, 130, 135, 131, 132
See application file for complete search history.

(56) References Cited

U.S. PATENT DOCUMENTS

| | | | | |
|---|---|---|---|---|
| 2,731,599 | A * | 1/1956 | Groeper | 73/514.39 |
| 3,265,931 | A * | 8/1966 | Gerry | 315/218 |
| 3,504,229 | A * | 3/1970 | Gerry | 315/209 M |
| 3,911,486 | A * | 10/1975 | Hibbard | 360/64 |
| 3,979,747 | A * | 9/1976 | Candida | 340/815.44 |
| 4,612,527 | A * | 9/1986 | Third et al. | 336/5 |
| 4,827,360 | A * | 5/1989 | Kawasaki et al. | 360/64 |
| 5,132,617 | A * | 7/1992 | Leach et al. | 324/207.16 |
| 5,696,419 | A * | 12/1997 | Rakestraw et al. | 310/268 |
| 6,218,924 | B1 | 4/2001 | Zabler et al. | |
| 7,071,657 | B2 * | 7/2006 | Tupper et al. | 322/29 |
| 7,586,232 | B2 * | 9/2009 | Lopatinsky et al. | 310/267 |
| 7,868,723 | B2 * | 1/2011 | Dobbs | 336/84 C |
| 2003/0056606 | A1 * | 3/2003 | Matsuura et al. | 73/862.191 |

FOREIGN PATENT DOCUMENTS

| | | | |
|---|---|---|---|
| DE | 195 30 589 | A1 | 2/1997 |
| EP | 0 762 618 | A1 | 3/1997 |
| EP | 1 742 235 | A2 | 1/2007 |
| WO | WO 2008/094919 | A2 | 8/2008 |

OTHER PUBLICATIONS

May 7, 2010 International Search Report issued in International Application No. PCT/EP2010/000053.
May 7, 2010 Written Opinion of the International Searching Authority issued in International Application No. PCT/EP2010/000053.

* cited by examiner

*Primary Examiner* — Mohamad Musleh
*Assistant Examiner* — Joselito Baisa
(74) *Attorney, Agent, or Firm* — Oliff & Berridge, PLC

(57) ABSTRACT

A rotary transformer includes a primary core having a primary coil wound thereon, and a secondary core having a secondary coil wound thereon, the cores being mounted for relative rotation about an axis of rotation. The transformer is characterized in that one of the cores includes a plurality of core segments arranged in spaced-apart relation relative to one another in a substantially circular array about the axis, and the other core has a substantially annular configuration. In a particular embodiment, the primary core is fixed and hence remains static during operation, and includes a plurality of spaced apart core segments arranged in a circular array around the axis.

10 Claims, 4 Drawing Sheets

ROTARY TRANSFORMER

The present invention relates to a rotary transformer, and in particular relates to a rotary transformer suitable for use in transferring electrical power between two parts of an assembly, such as an aero-engine or a wind-turbine, which rotate relative to one another.

It is common to provide a propulsive powerplant for an aircraft in the form of a turboprop comprising a propeller driven by a gas turbine engine. In such arrangements, there is a requirement to deliver electrical power from the static part of the aircraft into the rotating hub of the propeller for the purposes of powering propeller blade-pitch control devices and blade deicing devices. A similar electrical power requirement also exists in open rotor engines, such as propfan engines. For example, contra-rotating propfan engines which comprise a pair of contra-rotating unducted fans require electrical power to be transmitted across the static-rotating interface between the engine and the front hub, and also across the rotating-rotating interface between the front hub and the rear hub. Traditionally, this sort of electrical power transfer has been achieved using carbon brushes on the fixed part that form a sliding electrical contact with a slip ring provided on the rotating part. However it has been found that this approach is unfavorable, particularly in the case of open-rotor engines, because the large hub diameter and propeller speeds involved mean that the peripheral speed of the brushes can easily exceed the limit necessary to maintain mechanical integrity of the brushes.

In order to address the above-mentioned problems associated with using brushes and slip-rings, it has therefore been proposed to use rotary transformers to transfer electrical power to rotating hubs through mutual induction, thereby eliminating the need for physical contact between conductors across the static-rotating interface.

The choice of rotating transformer configuration is generally determined by the space constraints of the installation. For example, when there is significant space available and when weight is not a significant limiting factor, a transformer configuration such as that disclosed in EP1742235 is generally preferred. However, in weight-critical applications where only a relatively small radial space exists at a large diameter of rotation, then an arrangement such as that disclosed in EP1742235 is not viable. This sort of weight-critical, small-space scenario is typical in aircraft engines of the turboprop/propfan variety, where de-icing and blade-pitch-control systems in the rotating hubs must be fed from a static power source (where it is not favourable to generate electrical power within the rotating hub itself). A similar problem is encountered when electrical power must be delivered to the rotating hub of a wind or tidal turbine in order to control the pitch the rotor blades in dependence on wind or tidal conditions.

FIG. 1 illustrates the conventional configuration for a rotating transformer proposed for use in weight-critical applications where only a relatively small radial space is available in order to accommodate the transformer components. This configuration of rotary transformer has been particularly proposed for use in controlling the pitch of propeller blades.

As can be seen from FIG. 1, the previously proposed transformer 1 comprises a pair of opposed and substantially identical axisymmetric cores having a generally c-shaped radial cross-section. The primary core 2 is mounted to a fixed structure 3, such as an engine cover, and so is itself fixed in position. The primary core 2 is made from material having a high magnetic permeability, such as iron, as is conventional in transformer construction. The primary core 2 has a substantially c-shaped radial cross-section and hence defines a pair of concentric and substantially annular pole surfaces 4. A primary conducting coil 5 is wound around the primary core 2 such that each individual turn of the coil generally follows the circumference of the core, the turns passing from one side of the core to the other via an end-turn aperture formed through the core (not shown).

The secondary core 6 is fixedly mounted to a rotating structure 7 such as a propeller hub or the like. The rotating structure 7, and hence also the associated secondary core 6, is mounted for rotation relative to the fixed structure 3 and the associated fixed primary core 2 about an axis of rotation 8. As illustrated particularly in FIG. 2, the secondary core 6 defines a pair of concentric and substantially annular pole surfaces 9, each pole surface being radially aligned with a respective pole surface 4 of the primary core 2, and being axially spaced therefrom by a small air gap between the two cores 2, 6. As will also be noted, the secondary core 6 is also provided with a secondary coil 10 which is wound around the circumference of the core, with each turn spanning substantially the entire inner and outer circumferences of the core and passing from one side of the core to the other via an end-turn aperture formed through the core (not shown).

As will therefore be appreciated, the secondary core 6 and its associated coil 10 is thus mounted for substantially free rotation relative to the primary core 2 and its associated primary coil 5. Power transfer across the air gap is achieved by applying a time-varying voltage to the transformer's primary coil 5. This causes a time-varying current to flow through the primary coil 5, which establishes a time-varying magnetic flux in the transformer core. The configuration illustrated in FIG. 2 shows the flux travelling axially between the primary and secondary cores and a time-varying voltage is thus induced in the secondary coil 10, the magnitude of the voltage being determined by the relative number of turns in the primary and secondary coils 5, 10, in the conventional manner.

However, there have been found to be a number of disadvantages with the above-described prior art transformer configuration. Firstly, because the two cores are annular as well as having a c-shaped cross-section, it is difficult to construct the two cores so as to have a laminated structure. As will be appreciated by those of ordinary skill in the art of transformer construction, providing transformer cores of laminated construction is a common way to mitigate eddy-current losses arising in the core material (typically iron). In aerospace arrangements, there is particular importance in reducing the weight of a transformer, and this is often achieved by operating the transformer at a high injection frequency so that the core is able to transfer more power without reaching magnetic saturation, thereby allowing the core to be reduced in volume. However, a side-effect of increasing the injection frequency is that eddy-currents become more problematic, reducing efficiency through the dissipation of heat. By using transformer cores having a laminated construction, the effective eddy-current paths are shortened. However, it is essential for the laminations of the magnetic core structure to be laid-up so that the individual laminate cross-sections lie parallel to the magnetic flux path. In the case of the transformer configuration described above, which has a substantially axial magnetic flux path, this means that the c-section core rings must either be (i) built-up as circular structures from individual c-shaped laminations arranged at an angle to one another, (ii) laid-up as a stack of non-uniform circular laminations, or (iii) machined from a solid pre-laminated block. Each of these construction techniques are relatively complicated and expensive processes.

It has also been observed that the geometry of the above-mentioned prior art rotating transformer configuration provides only limited tolerance to variations in axial and radial displacement between the fixed and rotating parts. For example, it should be appreciated from FIG. 1 that should the fixed and rotating parts of the transformer arrangement be moved radially with respect to one another from the position illustrated in FIG. 1, then magnetic flux leakage will be increased as the facing poles 4, 9 move out of alignment with one another. This is because as the facing poles move out of alignment with one another, the secondary core 6 will capture less of the magnetic flux flowing from the primary core 2, thereby reducing the voltage induced in the rotating secondary part of the transformer.

It should also be noted that should the primary and secondary cores 2, 6 of the prior art arrangement be displaced axially, so as to move closer together or further apart thereby reducing or increasing the air gap in the transformer's magnetic path, then there will be a resulting variation in the transformer's magnetization inductance, with a resulting variation in the induced secondary voltage and current, thereby causing a ripple effect on the output of the transformer.

Also, it will be noted that in the prior art transformer configuration illustrated in FIGS. 1 and 2, the c-section cores extend fully around the circumference of the space occupied by the transformer. In some installations, it may be necessary, from a functional point of view, only to have a relatively small volume of iron core in order to transmit an appropriate level of power. However, the thickness of the two cores is also effected by the requirement to produce a mechanically robust design and so it can be the case that because of concerns with regard to mechanical robustness, the cores of the transformer contain a higher mass of iron than is actually necessary from a purely functional point of view, thereby unnecessarily increasing the overall weight of the installation.

It is therefore an object of the present invention to provide an improved rotary transformer.

According to the present invention, there is provided a rotary transformer comprising a primary core having a primary coil wound thereon, and a secondary core having a secondary coil wound thereon, wherein said cores are mounted for rotation relative to one another about an axis of rotation, the transformer being characterized in that one of said cores comprises a plurality of core segments arranged in spaced-apart relation relative to one another in a substantially circular array about said axis, the other core having a substantially annular configuration.

The transformer may be configured such that one of said cores is fixed and the other core is mounted for rotation relative to the fixed core about said axis of rotation.

Preferably said fixed core comprises said plurality of core segments, although it should be appreciated that in alternative embodiments of the invention it could be the rotatable core which is segmented, with the fixed core having a substantially annular configuration.

Preferably, said primary coil is said fixed coil, and said secondary coil is rotatable relative to said primary coil. However, it is also envisaged that said primary coil could be the rotatable coil, with the secondary coil being fixed.

Alternatively, both of said cores rotate about a said axis of rotation and power is transferred through relative rotation motion between primary and secondary cores.

Conveniently, one of said cores is substantially c-shaped in radial cross-section relative to said axis of rotation. Said c-shaped core most preferably has a pair of facing poles defining a gap therebetween. Said poles may either face one another in a substantially radial direction, such that magnetic flux passes radially across the gap. Alternatively, however, the poles may face one another in a substantially axial direction such that the magnetic flux passes axially across the gap.

In embodiments comprising such a c-shaped core, the other said core is preferably positioned substantially within said gap. In arrangements where the other core is the rotatable core, it is thus arranged to rotate freely in the gap between the poles.

Preferably, said c-shaped core comprises said plurality of core segments, each said core segment defining a respective said gap. In such an arrangement, said substantially annular core is preferably positioned such that at any instant rotational position between said two cores, a respective section of said annular core lies substantially within the gap of each said core segment.

Alternatively, the primary and secondary cores each comprise a plurality of core segments arranged in spaced-apart relation about said axis.

Conveniently, electronic data may be transmitted between primary and secondary core segments for control of engine components such as a pitch change mechanism.

So that the invention may be more readily understood, and so that further features thereof may be appreciated, embodiments of the invention will now be described by way of example with reference to the accompanying drawings in which.

Figure 1:
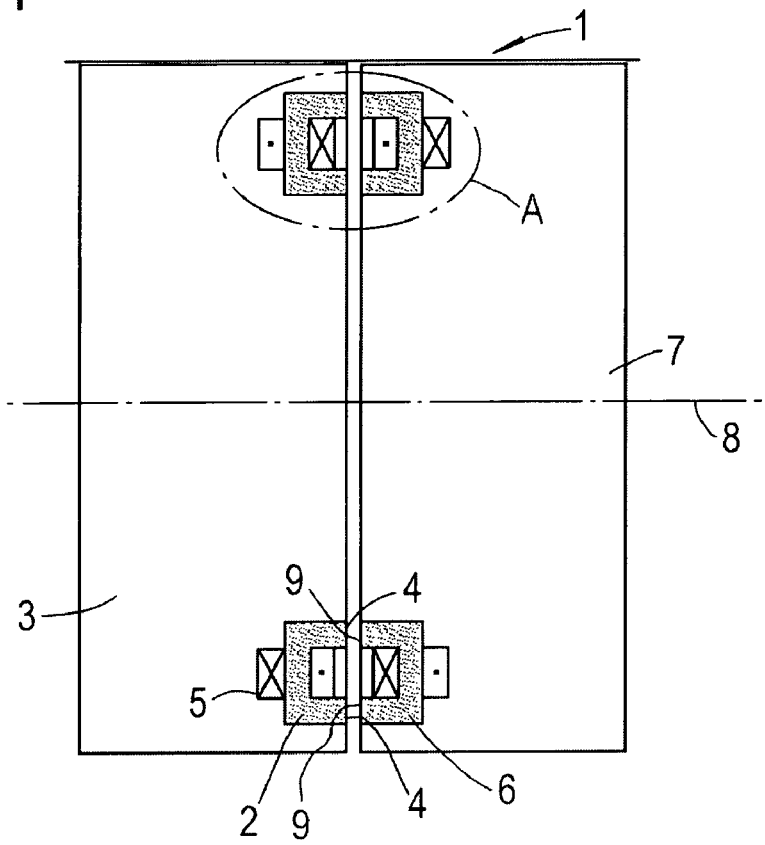
FIG. 1 (discussed above) is a cross-sectional view illustrating a previously-proposed rotary transformer.

Turning now to consider FIGS. 3 to 5, a first embodiment of the present invention will now be described. There is illustrated a rotary transformer 11 which is provided across the interface between a first structure 12 and a second structure 13. The two structures 12, 13 are mounted for rotation relative to one another about an axis of rotation 14.

It is to be appreciated that both the first structure and second structure 13 can be configured for independent rotation about the axis 14, such that both structures are free to rotate. For example, such an arrangement could be configured so that the first structure 12 forms part of the hub of a first rotating propeller, and the second structure 13 forms part of the hub of a second propeller mounted for co-rotation relative to the first propeller. Alternatively however, it is possible for one of the structures, for example the first structure 12, to be a fixed structure which remains static relative to the axis 14, whilst the other structure 13 is mounted for rotation about the axis 14. For example, such an arrangement might be configured so that the first structure 12 forms part of the cover or nacelle of an engine, and the second structure 13 forms part of the hub of a rotating propeller driven by the engine.

The transformer comprises a primary core 15 of material having a high magnetic permeability, such as iron, and a secondary core 16 formed from similar material. The primary core 15 is fixedly mounted to the first structure 12, and the secondary core 16 is fixedly mounted to the second structure 13, and so the secondary core 16 is effectively mounted for rotation relative to the primary core 15 about the axis of rotation 14.

Figure 5:
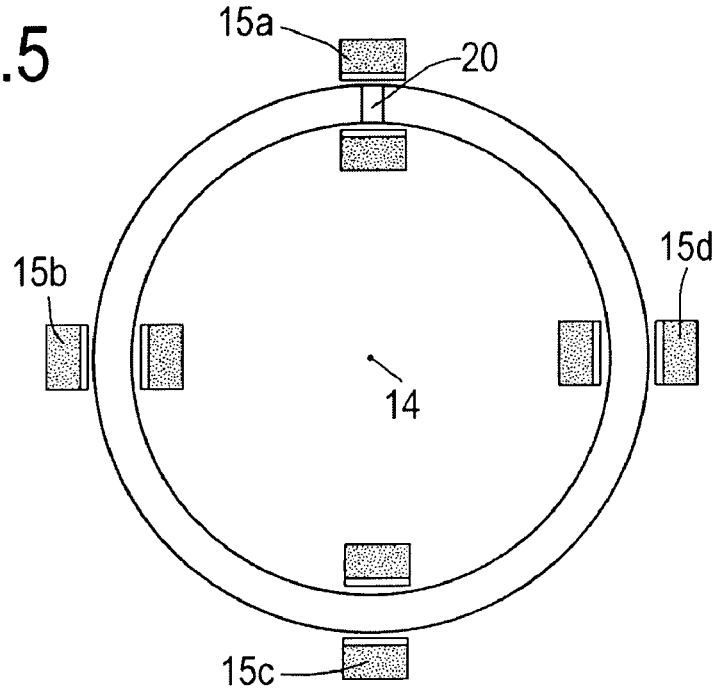
FIG. 5 is an axial view from the rear, showing the transformer of FIGS. 3 and 4.

Considering the structure of the primary core 15 in more detail, it will be seen from FIG. 5 which illustrates the rotary transformer in rear view, that the primary core 15 is actually divided into a number of discrete core segments 15*a*, 15*b*, 15*c* and 15*d*, each of which are mounted to the fixed structure 12. The individual core segments are arranged in spaced apart relation relative to one another in a generally circular array arranged around the axis of rotation 14. As will be noted, the particular arrangement illustrated in FIG. 5 comprises four core segments which are substantially equi-spaced from one another. However, it should be appreciated that in variants of the invention, fewer or more core segments could be used.

Figure 2:
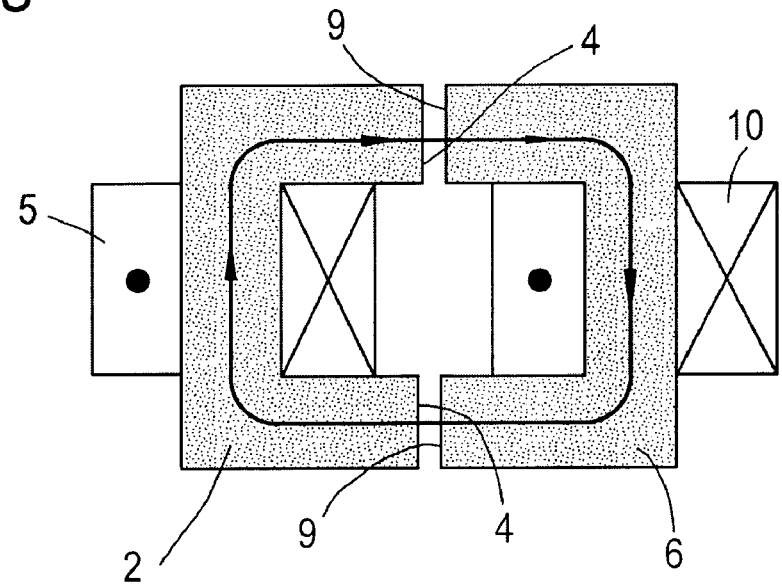
FIG. 2 (also discussed above) is an enlarged view of the region A of FIG. 1.

As will be noted from FIG. 5, each of the primary core segments 15*a*, 15*b*, 15*c*, 15*d* is substantially linear in the sense that the core segments have no significant curvature about the axis of rotation 14. Also, when viewed in FIGS. 3 and 4, it will be seen that the primary core 15, comprising the discrete core segments illustrated in FIG. 5, has a substantially uniform c-shaped cross section. It will therefore be appreciated that by virtue of being divided into discrete, relatively short and straight core segments 15*a*, 15*b*, 15*c*, 15*d*, the primary core can easily be assembled so as to have a laminated construction. For example, each of the discrete core segments can be formed by laying up a series of substantially identical c-shaped laminations in parallel relation to one another. This is in contrast to the ring-shaped primary core 2 of the prior art arrangement illustrated in FIGS. 1 and 2, where individual c-shaped laminations would need to be laid-up so as to make an angle relative to one another in order that the completed structure has the circular configuration required.

It should also be noted that by dividing the primary core 15 into discrete core segments as illustrated in FIG. 5, the overall weight of the core can be reduced and so it no longer becomes necessary to include a higher mass of iron in the core than is necessary for electrical operation of the transformer simply to provide the core with sufficient mechanical integrity.

The primary core 15 is provided with a primary coil 17 of electrically conductive wire. The primary coil 17 is sequentially wound around the discrete primary core segments 15*a*, 15*b*, 15*c* and 15*d* so as to have a winding direction as illustrated schematically in FIGS. 3 and 4. As the primary core 15 is divided into discrete core segments, the end-turns of the coil windings around each respective core segment can simply be provided at one end of each core segment, rather than necessitating an end-turn aperture.

Figure 3:
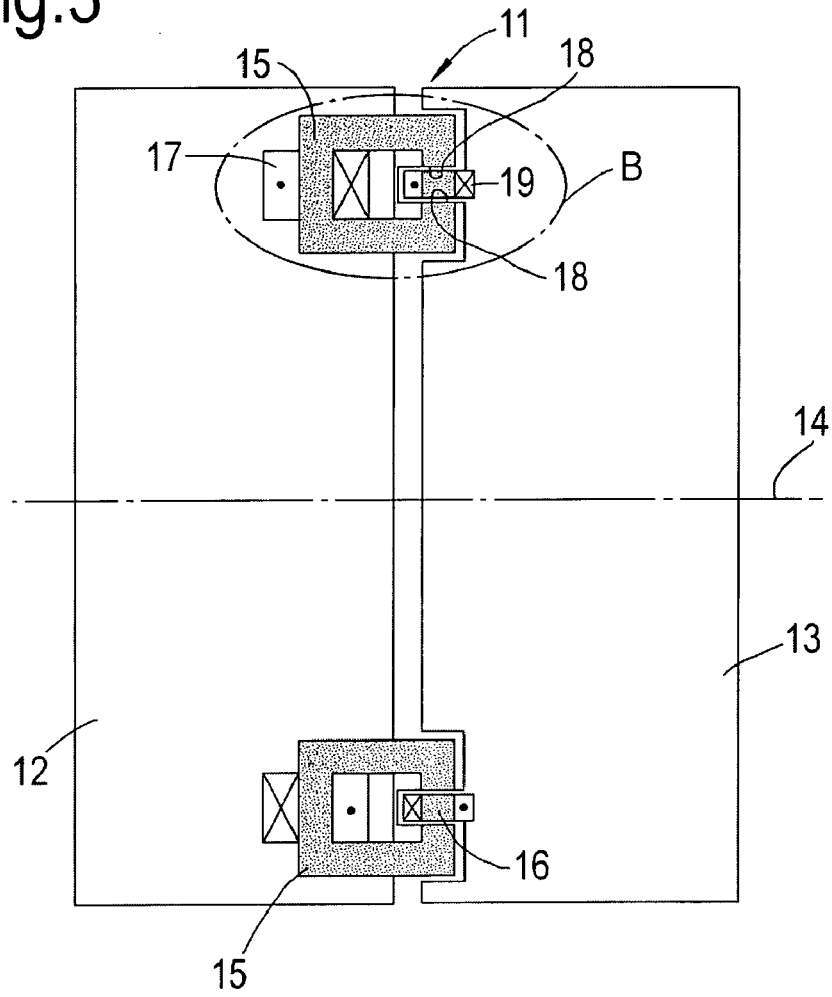
FIG. 3 is a view similar to that of FIG. 1, but illustrating a rotating transformer in accordance with one embodiment of the present invention.
Figure 4:
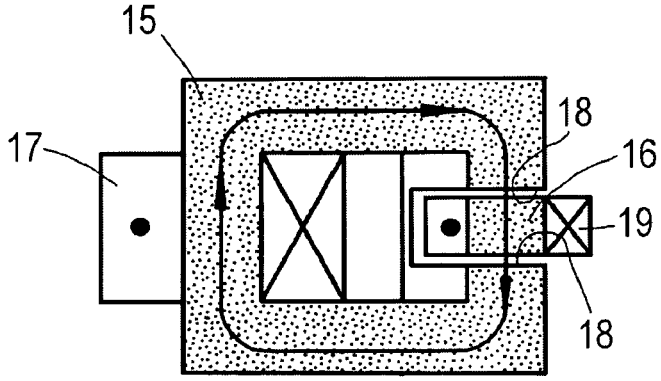
FIG. 4 is an enlarged view of the region B of FIG. 3.

As illustrated most clearly in FIGS. 3 and 4, the primary core 15 has a configuration such that in radial cross-section it defines a substantially c-shape having a pair of spaced apart poles 18 which face one another in a substantially radial direction. This is in contrast to the prior art arrangement of FIGS. 1 and 2, in which the two pole surfaces 4 of the primary core 2 were arranged so as to be substantially radially aligned with one another and coplanar. In the arrangement of the present invention, an air-gap is thus formed between the facing primary poles 18, and it will be seen from FIGS. 3 and 4 that the secondary core 16 is arranged to sit within this gap.

The secondary core 16 is annular in form so as to define a substantially continuous ring around which is wound a secondary coil 19 of electrically conductive wire.

The individual turns of the secondary coil 19 run around substantially the entire circumference of the secondary core 16, and pass from one side of the core to the other via an end-turn aperture 20 provided through the secondary core 16 as illustrated schematically in FIG. 5.

It should be noted that due to the very simple structure of the secondary core 16, the secondary core also lends itself to convenient lamination. For example, it is envisaged that the annular secondary core 16 could conveniently be constructed by laying-up a series of identical circular ring-shaped laminations. Again, in such a construction, there would be no need to angle neighbouring laminations relative to one another, or to use laminations of different shapes, thereby making the lamination procedure much more simple.

Referring now in particular to FIG. 4, it will be noted that in the configuration illustrated, the magnetic flux flows between the primary core 15 and the secondary core 16 in a substantially radial direction. Because the air-gap between the facing poles 18 of the primary core 15 is held constant by virtue of being defined by two opposing poles of the same core, then any radial deflection of the secondary core 16 relative to the primary core 15 will have little effect on the flow of magnetic flux between the two cores, thereby making this configuration more tolerant to radial displacements.

Although axial displacements between the two cores 15, 16 could still result in a variation in the flow of magnetic flux, it should be noted that the configuration of the secondary annular core 16 lends itself particularly well to be slightly enlarged in an axial direction so as to have a larger axial extent than the two facing poles 18. Such an enlarged configuration of the secondary core 16 would thus serve easily to increase the tolerance of the arrangement to axial deflections between the two cores.

Figure 6:
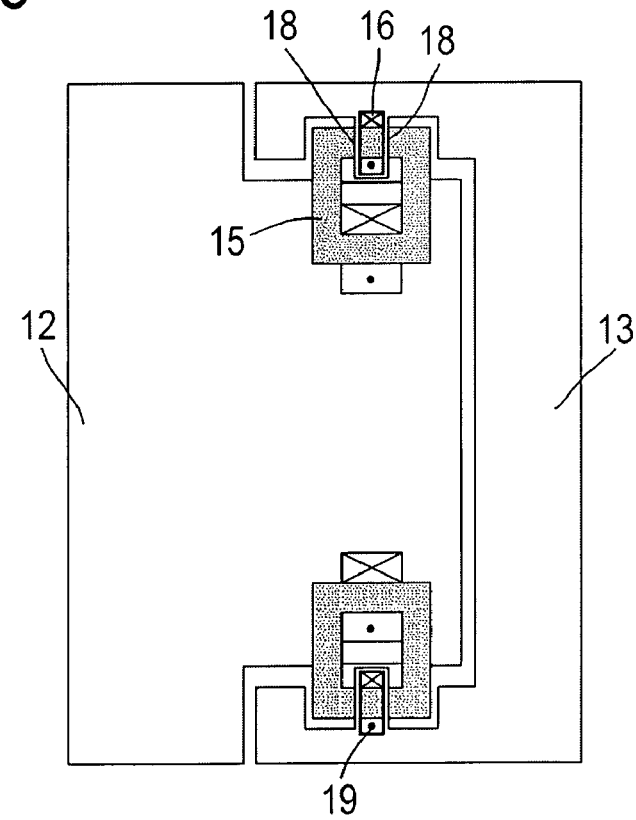
FIG. 6 is a view similar to that of FIG. 3, but illustrating a rotary transformer in accordance with another embodiment of the present invention.

Turning now to consider FIG. 6, there is illustrated a further embodiment of the present invention in which the primary core 15 is arranged such that its facing poles 18 face one another in a substantially annular direction rather than in a substantially radial direction as in the case of the embodiment shown in FIG. 4. As will be appreciated, this arrangement necessitates a corresponding change in orientation of the secondary core 16 and its associated secondary coil 19, but in other respects the features of the primary and secondary cores remain substantially unchanged. It will be appreciated that in this arrangement, the magnetic flux flows between the primary and secondary cores 15, 16 in a substantially axial direction as opposed to the radial direction of the arrangement illustrated in FIG. 4. This arrangement is thus naturally tolerant to axial displacement between the two cores by virtue of the orientation of the air gap between the facing poles 18 of the primary core 15.

The segmented nature of the primary core 15 allows for a degree of modularity in the transformer, permitting redundancy on one side of the transformer. This could be used as a building block for a fault-tolerant system, where the use of redundant cores could allow the system to operate even in the event of one or several single-point core failures.

Whilst the invention has been described above with specific reference to specific embodiments in which either the two cores are each independently rotatable, or the primary core is fixed and the secondary core is rotatable, it should be appreciated that the claimed invention also encompasses arrangements in which the secondary core is fixed and the primary core is rotatable. Similarly, it is also envisaged that the secondary core could be segmented, and the primary core annular. Furthermore, the c-sectioned core could be provided in the form of a substantially complete annulus, with the other core being segmented.

In the case where intermittent power is acceptable, an alternative embodiment in which both primary and secondary cores comprise a plurality of core segments arranged in spaced-apart relation relative to one another in a substantially circular array about said axis would be preferred. This embodiment has the added advantages of being lighter in weight, and easier to assemble, as both primary and secondary cores are comprised of laminated construction.

Figure 7:
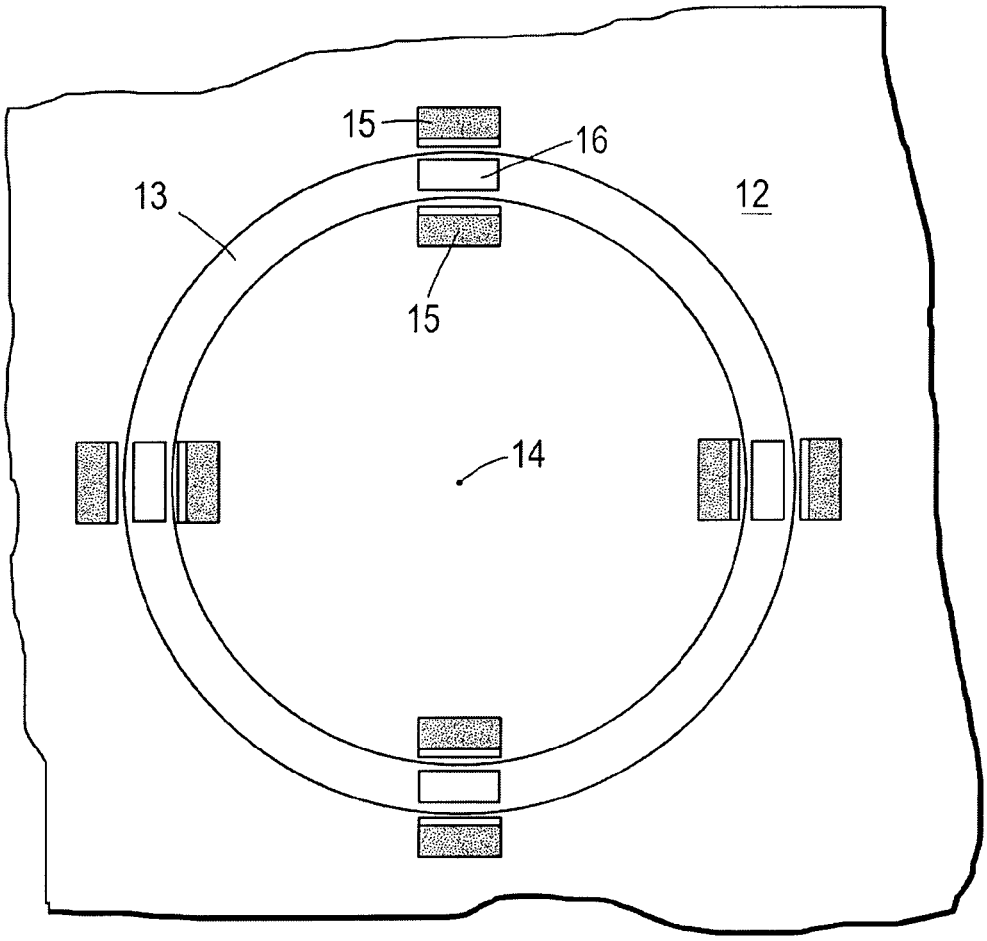
FIG. 7 is an axial view from the rear of another embodiment of the present invention.

So that this embodiment of the invention may be more readily understood, FIG. 7 illustrates an axial view from the rear of this further embodiment. The cross-sectional view of this embodiment is similar to FIG. 3 of the invention application.

In essence, this embodiment comprises a segmented primary core (15 of FIG. 3) which is fixedly mounted to the first structure (12 of FIG. 3), and a segmented secondary core (16 of FIG. 3) is fixedly mounted to the second structure (13 of FIG. 3), and so the secondary core 16 is effectively mounted for rotation relative to the primary core 15 about the axis of rotation (14 of FIG. 3).

Considering the structure of this embodiment in more detail, it will be seen from FIG. 7 which illustrates the rotary transformer in rear view, that both the primary and secondary cores are actually divided into a number of discrete core segments. Core segments of the primary core are fixedly mounted to the first structure (12 of FIG. 3), whilst core segments of the secondary core are fixedly mounted to the second structure (13 of FIG. 3). FIG. 7 comprises four sets of primary-secondary core segments which are substantially equi-spaced from one another. However, it should be appreciated that in variants of the invention, fewer or more core segments could be used.

The individual core segments are arranged in spaced apart relation relative to one another in a generally circular array arranged around the axis of rotation 14. Each core segment is substantially linear in the sense that the core segments have no significant curvature about the axis of rotation 14.

Rather than for power transfer, this doubly-segmented embodiment of the invention is also ideally suited for data transfer application where intermittent information transfer is acceptable.

In the case where power transfer and data transfer are required at the same time, a dedicated set of primary-secondary core segments can be used to carry data whilst the rest of the core segments are utilized for power transfer. Alternatively, data could be transferred by utilizing high frequency carrier that is modulated onto the power frequency waveform. Such data may be electronic signals for control of engine components such as a pitch change mechanism or for monitoring the condition of such components.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A rotary transformer comprising:

a primary core having a primary coil wound thereon; and a secondary core having a secondary coil wound thereon, wherein the primary core and the secondary core are mounted for rotation relative to one another about an axis of rotation, one of the primary and secondary cores comprises a plurality of core segments arranged in spaced-apart relation relative to one another in a substantially circular array about the axis of rotation, one of the other of the primary and secondary cores having a substantially annular configuration, and one of the primary and secondary cores is substantially c-shaped in radial cross-section, the substantially c-shaped core comprising:

a pair of facing poles defining a gap therebetween; and the plurality of core segments, each of the plurality of core segments defining a respective gap, wherein the substantially annular core is positioned such that at any instant rotational position between the primary and secondary cores, a respective section of the annular core lies substantially within the gap of each of the plurality of core segments.

2. The rotary transformer of claim 1, wherein one of the primary and secondary cores is fixed, and the other of the primary and secondary cores is mounted for rotation relative to the fixed core about the axis of rotation.

3. The rotary transformer of claim 2, wherein the fixed core comprises the plurality of core segments.

4. The rotary transformer of claim 2, wherein the primary coil is the fixed coil, and the secondary coil is rotatable relative to the primary coil.

5. The rotary transformer of claim 1, wherein the primary and secondary cores rotate about the axis of rotation, and power is transferred through relative rotation motion between the primary and secondary cores.

6. The rotary transformer of claim 1, wherein the pair of facing poles face one another in a substantially radial direction.

7. The rotary transformer of claim 1, wherein the pair of facing poles face one another in a substantially axial direction.

8. The rotary transformer of claim 1, wherein the other the primary and secondary cores is positioned substantially within the gap.

9. The rotary transformer of claim 1, wherein the primary and secondary cores each comprise a plurality of core segments arranged in spaced-apart relation about the axis of rotation.

10. The rotary transformer of claim 1, wherein electronic data is transmitted between primary and secondary core segments.

* * * * *